US011345570B2

(12) United States Patent
Fauconnet et al.

(10) Patent No.: US 11,345,570 B2
(45) Date of Patent: May 31, 2022

(54) ELECTRONIC SAFETY ACTUATOR ELECTROMAGNETIC GUIDANCE

(71) Applicant: Otis Elevator Company, Farmington, CT (US)

(72) Inventors: Aurelien Fauconnet, Isdes (FR); Gerard Sirigu, Gien (FR)

(73) Assignee: OTIS ELEVATOR COMPANY, Farmington, CT (US)

( * ) Notice: Subject to any disclaimer, the term of this patent is extended or adjusted under 35 U.S.C. 154(b) by 298 days.

(21) Appl. No.: 16/418,744

(22) Filed: May 21, 2019

(65) Prior Publication Data

US 2020/0002130 A1 Jan. 2, 2020

(30) Foreign Application Priority Data

Jun. 28, 2018 (EP) ..... 18305826

(51) Int. Cl.
*B66B 5/18* (2006.01)
*B66B 5/16* (2006.01)
*B66B 11/02* (2006.01)

(52) U.S. Cl.
CPC ..... *B66B 5/18* (2013.01); *B66B 5/16* (2013.01); *B66B 11/028* (2013.01)

(58) Field of Classification Search
CPC ..... B66B 5/18; B66B 11/026; B66B 11/028; B66B 5/22
See application file for complete search history.

(56) References Cited

U.S. PATENT DOCUMENTS 5,467,850 A * 11/1995 Skalski ..... B66B 5/16 187/373
7,575,099 B2 * 8/2009 Oh ..... B66B 5/06 187/247

(Continued)

FOREIGN PATENT DOCUMENTS

CN 1165109 A 11/1997
CN 1210806 A 3/1999

(Continued)

OTHER PUBLICATIONS

Appunn et al., "Electromagnetic Guiding of Vertical Transportation Vehicles: Experimental Evaluation", IEEE Transactions On Industrial Electronics, vol. 57, No. 1, Jan. 2010, pp. 335-343.

(Continued)

*Primary Examiner* — Michael R Mansen
*Assistant Examiner* — Michelle M Lantrip
(74) *Attorney, Agent, or Firm* — Cantor Colburn LLP

(57) ABSTRACT

An elevator car is provided and includes a car frame which translates along a guide rail during ascents or descents, a safety disposed along the car frame to selectively engage with the guide rail to selectively permit vertical elevator car movement, an electronic safety actuator (ESA) and a control system. The ESA actuates the safety and includes an ESA body secured to the car frame with horizontal maneuverability and defining a groove through which the guide rail translates during the vertical elevator car movement, a magnetic guide operably disposed within the groove to exert magnetic force on the guide rail and a sensor disposed within the groove to sense horizontal distance between the guide rail and corresponding portions of the ESA body. The control system controls the magnetic guide to exert a magnetic force in accordance with reading of the sensor to maneuver the ESA body horizontally.

6 Claims, 5 Drawing Sheets

(56) References Cited

U.S. PATENT DOCUMENTS

| | | | | |
|---|---|---|---|---|
| 7,721,852 | B2 | 5/2010 | Shioka et al. | |
| 7,766,128 | B2 | 8/2010 | Takeuchi et al. | |
| 7,849,972 | B2 | 12/2010 | Hagashinaka | |
| 7,909,145 | B2 | 3/2011 | Erny et al. | |
| 8,264,311 | B2 | 9/2012 | Ito et al. | |
| 8,573,365 | B2 * | 11/2013 | Ito | B66B 5/22 187/374 |
| 9,688,512 | B2 | 6/2017 | West et al. | |
| 2007/0007083 | A1 * | 1/2007 | Husmann | B66B 5/18 187/366 |
| 2012/0043167 | A1 | 2/2012 | Yokobayashi | |
| 2013/0248296 | A1 * | 9/2013 | Husmann | B66B 5/125 187/251 |
| 2013/0248298 | A1 * | 9/2013 | Osmanbasic | B66B 5/20 187/359 |
| 2016/0137455 | A1 | 5/2016 | May | |
| 2016/0236904 | A1 | 8/2016 | Witczak et al. | |
| 2016/0280511 | A1 | 9/2016 | Anderson et al. | |
| 2017/0066627 | A1 | 3/2017 | Hu et al. | |
| 2017/0129741 | A1 * | 5/2017 | Hu | B66B 5/18 |

FOREIGN PATENT DOCUMENTS

| | | | | |
|---|---|---|---|---|
| CN | 1756710 | A | 4/2006 | |
| CN | 107416637 | A * | 12/2017 | |
| JP | 2002356284 | A * | 12/2002 | B66B 5/28 |
| WO | WO-2006054328 | A1 * | 5/2006 | B66B 5/04 |
| WO | WO-2015191695 | A1 * | 12/2015 | B66B 5/04 |
| WO | WO-2017023926 | A1 * | 2/2017 | B66B 5/04 |
| WO | WO-2017087978 | A1 * | 5/2017 | B66B 5/04 |

OTHER PUBLICATIONS

ChaitaliMahale et al., "Development of Rope Free, Motorless Elevator Which Can Move in Vertical as Well as Horizontal Direction Using Electromagnetic Principle", International Journal of Interdisciplinary Innovative Research &Development (IJIIRD), 2017, 5 pages.

ICo-Op, "Industrial Cooperation and Creative Engineering Education Based on Remote Engineering and Virtual Instrumentation", 2015, 20 pages.

Mayr, "Elevator Brakes", 2015, Online download, URL:< https://www.mayr.com/synchronisation/documentations/img_806_v01_en_31_08_2015.pdf >,24 Pages.

Search Report dated Jan. 4, 2019 in U321226EP, EP Application. 18305826.2, 6 pages.

* cited by examiner

ELECTRONIC SAFETY ACTUATOR ELECTROMAGNETIC GUIDANCE

CROSS REFERENCE TO RELATED APPLICATION

This patent application claims priority to European Patent Application Serial No. 18305826.2, filed Jun. 28, 2018, which is incorporated herein by reference in its entirety.

BACKGROUND

The following description relates to elevator systems and, more specifically, to elevator systems having electronic safety actuators (ESAs).

Elevator systems generally make use of governor systems to monitor the rate of descent of an elevator car and to engage safety devices in an event the elevator car descends at an excessive speed. A typical governor system would be responsive to elevator car speeds through couplings, such as a governor sheave coupled to a rope that is attached to an elevator car, whereby the rope transmits elevator car speed to the governor. When a predetermined speed is exceeded, conventional actuators, such as centrifugal flyweights, trigger a first set of switches. If the car speed continues to increase, additional mechanics engage to impede elevator car movement.

In modern elevator systems, ESAs may replace governor systems and operate by electronically engaging safeties. The safeties are normally maintained at a distance from guiderail blades so that the elevator cars can move freely. This distance maintenance may be provided by gibs or rollers. While the gibs or rollers can provide guidance for the ESAs, they are prone to wear over time and may produce undesirable noise and vibration.

BRIEF DESCRIPTION

According to an aspect of the disclosure, an elevator car is provided and includes a car frame which translates along a guide rail during ascents or descents, a safety disposed along the car frame to selectively engage with the guide rail to selectively permit vertical elevator car movement, an electronic safety actuator (ESA) and a control system. The ESA is configured to actuate the safety and includes an ESA body secured to the car frame with horizontal maneuverability and defining a groove through which the guide rail translates during the vertical elevator car movement, a magnetic guide operably disposed within the groove to exert magnetic force on the guide rail and a sensor disposed within the groove to sense horizontal distance between the guide rail and corresponding portions of the ESA body. The control system is configured to control the magnetic guide to exert a magnetic force in accordance with reading of the sensor to maneuver the ESA body horizontally.

In accordance with additional or alternative embodiments, the car frame, the safety and the ESA are provided in sets on opposite elevator car sides.

In accordance with additional or alternative embodiments, the ESA includes a linkage coupled to the ESA body and the safety for actuation of the safety.

In accordance with additional or alternative embodiments, the ESA body defines horizontal grooves through which a fastener extends into the car frame.

In accordance with additional or alternative embodiments, the magnetic guide includes one or more electro-magnets respectively disposed in at least one of an upper portion of the groove, a lower portion of the groove and a middle portion of the groove.

In accordance with additional or alternative embodiments, the magnetic guide further includes one or more permanent magnets respectively disposed to magnetically oppose the one or more electro-magnets.

In accordance with additional or alternative embodiments, the magnetic guide includes one or more electro-magnets disposed in an upper portion of the groove and one or more electro-magnets disposed in a lower portion of the groove.

In accordance with additional or alternative embodiments, the magnetic guide includes one or more permanent magnets disposed in the upper portion of the groove to magnetically oppose the one or more permanent magnets therein and one or more permanent magnets disposed in the lower portion of the groove to magnetically oppose the one or more permanent magnets therein.

In accordance with additional or alternative embodiments, the magnetic guide includes a first pair of magnetic guides disposed on opposite sides of an upper portion of the groove and a second pair of magnetic guides disposed on opposite sides of a lower portion of the groove.

In accordance with additional or alternative embodiments, the control system is configured to control the magnetic guide to increase the magnetic force when the readings of the sensor are indicative of the horizontal distance decreasing.

According to an aspect of the disclosure, an electronic safety actuator (ESA) is provided for actuating an elevator car safety. The ESA includes an ESA body vertically secured to the elevator car with horizontal maneuverability, the ESA body defining a groove through which a guide rail, along which the elevator car moves vertically, is translatable, a magnetic guide operably disposed within the groove to exert magnetic force on the guide rail, a sensor disposed within the groove to sense horizontal distance between the guide rail and corresponding portions of the ESA body and a control system configured to control the magnetic guide to exert the magnetic force in accordance with readings of the sensor to maneuver the ESA body horizontally.

In accordance with additional or alternative embodiments, the ESA body is formed to define horizontal grooves through which a fastener extends.

In accordance with additional or alternative embodiments, the magnetic guide includes one or more electro-magnets respectively disposed in at least one of an upper portion of the groove, a lower portion of the groove and a middle portion of the groove.

In accordance with additional or alternative embodiments, the magnetic guide further includes one or more permanent magnets respectively disposed to magnetically oppose the one or more electro-magnets.

In accordance with additional or alternative embodiments, the magnetic guide includes one or more electro-magnets disposed in an upper portion of the groove and one or more electro-magnets disposed in a lower portion of the groove.

In accordance with additional or alternative embodiments, the magnetic guide includes one or more permanent magnets disposed in the upper portion of the groove to magnetically oppose the one or more permanent magnets therein and one or more permanent magnets disposed in the lower portion of the groove to magnetically oppose the one or more permanent magnets therein.

In accordance with additional or alternative embodiments, the magnetic guide includes a first pair of magnetic guides disposed on opposite sides of an upper portion of the groove and a second pair of magnetic guides disposed on opposite sides of a lower portion of the groove.

In accordance with additional or alternative embodiments, the control system is configured to control the magnetic guide to increase the magnetic force when the readings of the sensor are indicative of the horizontal distance decreasing.

According to an aspect of the disclosure, a method of operating an electronic safety actuator (ESA) of an elevator car is provided. The method includes disposing a guide rail for translation within a groove defined in an ESA body, which is vertically secured to the elevator car with horizontal maneuverability, generating magnetic forces that are directed horizontally to maintain respective distances between the guide rail and complementary surfaces of the ESA body, sensing the respective distances and controlling the generating of the magnetic forces to maneuver the ESA body horizontally to maintain the respective distances.

In accordance with additional or alternative embodiments, the generating of the magnetic forces includes at least one of generating repulsive magnetic forces in opposite horizontal directions at an upper portion of the groove, generating repulsive magnetic forces in opposite horizontal directions at a lower portion of the groove and generating repulsive magnetic forces in opposite horizontal directions at a middle portion of the groove.

These and other advantages and features will become more apparent from the following description taken in conjunction with the drawings.

BRIEF DESCRIPTION OF THE DRAWINGS

The subject matter, which is regarded as the disclosure, is particularly pointed out and distinctly claimed in the claims at the conclusion of the specification. The foregoing and other features and advantages of the disclosure are apparent from the following detailed description taken in conjunction with the accompanying drawings in which:

These and other advantages and features will become more apparent from the following description taken in conjunction with the drawings.

DETAILED DESCRIPTION

As will be described below, generally reduced-contact levitation of an ESA body relative to guide rails is provided by the control of electro-magnetic forces by electro-magnetic actuators (EMAs). One or more position sensors (e.g., inductive sensors) are used to determine a distance between each EMA and the corresponding guide rail and the control system modifies/modulates the force of each EMA accordingly in order to avoid an incident in which any ESA body touches the guide rail and to guarantee that a certain amount of clearance is maintained.

Figure 1:
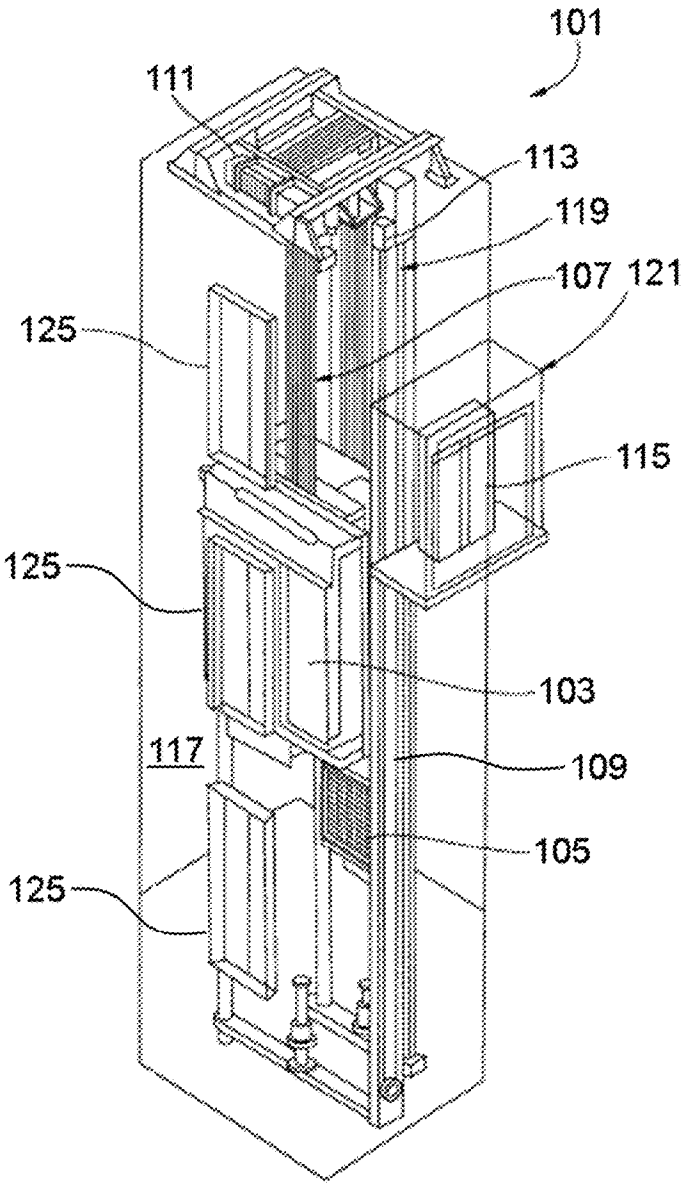
FIG. 1 is a perspective view of an elevator system in accordance with embodiments.
Figure 3:
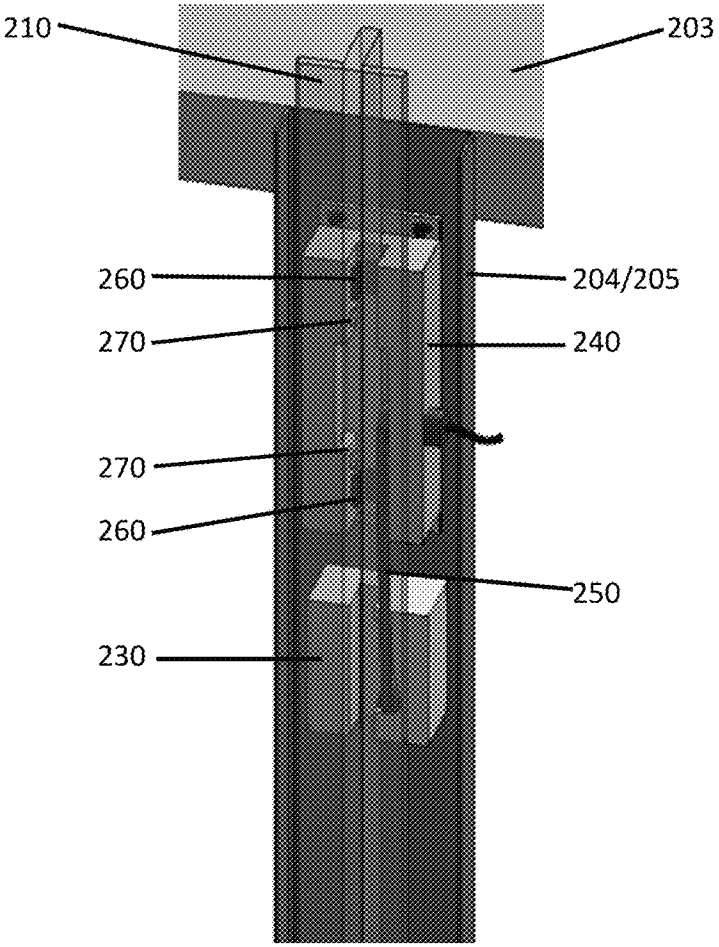
FIG. 3 is a perspective view of a safety and an electronic safety actuator (ESA) associated with the safety in accordance with embodiments.

FIG. 1 is a perspective view of an elevator system 101 including an elevator car 103, a counterweight 105, a roping 107, a guide rail 109, a machine 111, a position encoder 113, and a controller 115. The elevator car 103 and counterweight 105 are connected to each other by the roping 107. The roping 107 may include or be configured as, for example, ropes, steel cables, and/or coated-steel belts. The counterweight 105 is configured to balance a load of the elevator car 103 and is configured to facilitate movement of the elevator car 103 concurrently and in an opposite direction with respect to the counterweight 105 within an elevator shaft 117 and along the guide rail 109.

The roping 107 engages the machine 111, which is part of an overhead structure of the elevator system 101. The machine 111 is configured to control movement between the elevator car 103 and the counterweight 105. The position encoder 113 may be mounted on an upper sheave of a speed-governor system 119 and may be configured to provide position signals related to a position of the elevator car 103 within the elevator shaft 117. In other embodiments, the position encoder 113 may be directly mounted to a moving component of the machine 111, or may be located in other positions and/or configurations as known in the art.

The controller 115 is located, as shown, in a controller room 121 of the elevator shaft 117 and is configured to control the operation of the elevator system 101, and particularly the elevator car 103. For example, the controller 115 may provide drive signals to the machine 111 to control the acceleration, deceleration, leveling, stopping, etc. of the elevator car 103. The controller 115 may also be configured to receive position signals from the position encoder 113. When moving up or down within the elevator shaft 117 along guide rail 109, the elevator car 103 may stop at one or more landings 125 as controlled by the controller 115. Although shown in a controller room 121, those of skill in the art will appreciate that the controller 115 can be located and/or configured in other locations or positions within the elevator system 101.

The machine 111 may include a motor or similar driving mechanism. In accordance with embodiments of the disclosure, the machine 111 is configured to include an electrically driven motor. The power supply for the motor may be any power source, including a power grid, which, in combination with other components, is supplied to the motor.

Although shown and described with a roping system, elevator systems that employ other methods and mechanisms of moving an elevator car within an elevator shaft, such as hydraulic and/or ropeless elevators, may employ embodiments of the present disclosure. FIG. 1 is merely a non-limiting example presented for illustrative and explanatory purposes.

Figure 2:
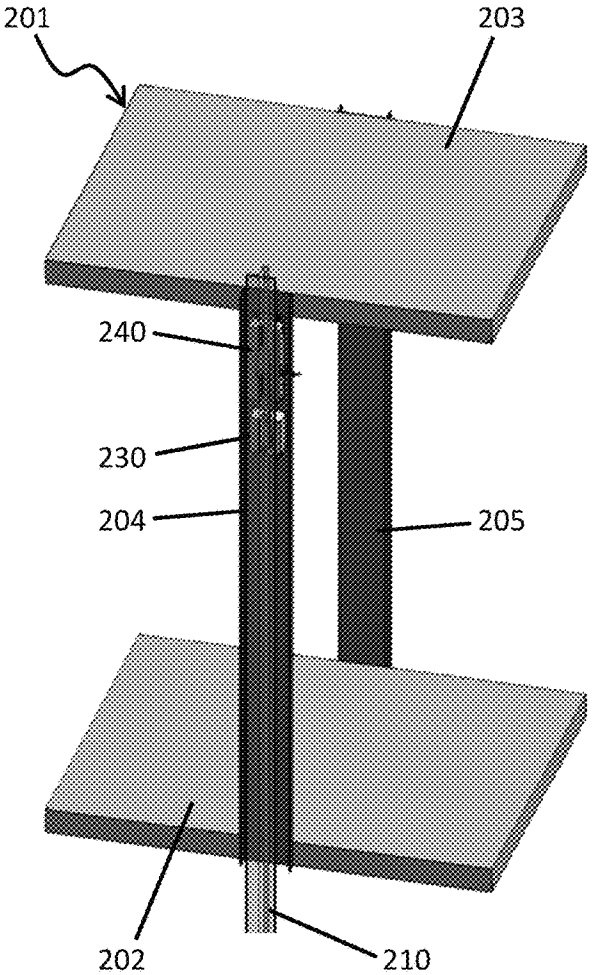
FIG. 2 is a perspective view of an elevator system with electronically actuated safeties in accordance with embodiments.

With reference to FIG. 2, an elevator car 201 is provided and may be generally configured in a similar manner as the elevator car 103 of the elevator system 101 of FIG. 1. Thus, the elevator car 201 includes a platform 202, a ceiling 203 and car frame structures 204 and 205 on either side of the elevator car 201 to maintain the ceiling 203 above the platform 202. In one embodiment, any number or position of car frame structures 204 and 205 may be employed. The elevator car 201 moves from one floor to another in a building or structure along guide rails 210. In most instances, the elevator car 201 has a body, which includes the platform 202, the ceiling 203 and the car frame structures 204 and 205 and is configured to accommodate one or more passengers and baggage. The elevator car 201 may also include doors which open and close to permit entry and exit from the interior and a control panel that allows the passengers to input commands.

In an event the elevator car 201 begins to ascend or descend too quickly, the elevator car 201 also has safety features that can be engaged to slow the elevator car 201 down or to stop it altogether.

With continued reference to FIG. 2 and with additional reference to FIGS. 3-6, the safety features include safeties 230 and electrical safety actuators (ESAs) 240.

The safeties 230 may each be affixed to the first and second car frame structures 204 and 205 at the opposite sides of the elevator car 201 (although it is to be understood that the safeties 230 can be affixed to a same side or to adjacent sides of the elevator car 201 and that multiple safeties 230 can be affixed to a particular side of the elevator car 201) so that each safety 230 is at least proximate to a corresponding guide rail 210. Each safety 230 is configured engage with the corresponding guide rail 210 or to remain disengaged from the corresponding guide rail 210. When it is engaged, the safety 230 impedes movement of the elevator car 201 along the corresponding guide rail 210 and, when disengaged, the safety 230 permits movement of the elevator car 201 along the corresponding guide rail 210. The safeties 230 are normally disengaged.

The safeties 230 each include a safety body 231, a channel 232 that is defined through the safety body 231 and one or more wedge elements 233. When installed, the corresponding guide rail 210 extends into and through the channel 232 so that the guide rail 210 can translate within the channel 232 as the elevator car 201 ascends or descends. The wedge elements 233 are disposed in or proximate to the channel 232. When the safety 230 occupies the unengaged position, the wedge elements 233 do not engage or at least do not forcefully engage with the portion of the guide rail 210 in the channel 222 via a safety roller or wedge 251 of an ESA tie rod 250 (to be described further below). When the safety 230 occupies the engaged position, the wedge elements 233 engage with the portion of the guide rail 210 in a forceful manner via the safety roller or wedge 251 that is sufficient to impede or prevent the elevator car 201 from ascending or descending. Such engagement is typically frictional and sufficient to slow or stop the elevator car 201 (particularly when each safety 230 occupies the engaged position).

While the wedge elements 233 can be provided as one or more wedge elements 233, the following description will relate only to the case in which a single wedge element 233 is provided in each safety 230. This is done for purposes of clarity and brevity and is not intended to otherwise limit the scope of the disclosure.

Figure 4:
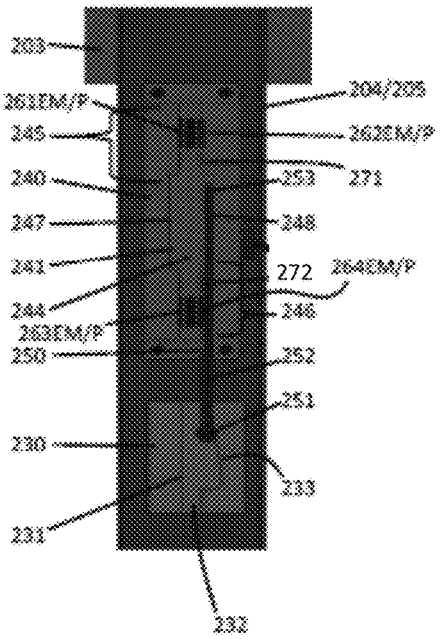
FIG. 4 is an elevational view of the safety and the ESA of FIG. 3.

The ESAs 240 are respectively coupled to corresponding safeties 230 by the ESA tie rods 250. Each ESA tie rod 250 includes an elongate member 252, an ESA pad 253 at a first end of the elongate member 252 and the safety roller or wedge 251 at a second end of the elongate member. Each ESA 240 includes one or more electromagnetic actuators that are configured to deploy the ESA pad 253 toward the corresponding guide rail 210 when the elevator car 201 ascends or descends excessively fast. As shown in FIG. 4, the deployed ESA pad 253 becomes electromagnetically secured to the corresponding guide rail 210 and causes the ESA tie rod 250 to become elevated relative to the safety 230 and the ESA 240. The results in the safety roller or wedge 251 becoming frictionally wedged between the wedge element 233 and the proximal portion of the guide rail 210. The frictional contact between the wedge element 233, the safety roller or wedge 251 and the corresponding guide rail 210 is sufficient to slow or brake the elevator car 201.

Each ESA 240 is thus configured to actuate the corresponding safety 230 by deploying the ESA pad 253 toward the corresponding guide rail 210 and includes an ESA body 241. The ESA body 241 is secured to the corresponding one of the first and second car frame structures 204 and 205. The securing of the ESA body 241 is accomplished so as to prevent vertical movement of the ESA body 241 relative to the corresponding one of the first and second car frame structures 204 and 205 while allowing for lateral or horizontal movement of the ESA body 241 relative to the corresponding one of the first and second car frame structures 204 and 205. That is, the ESA body 241 is vertically secured to the corresponding one of the first and second car frame structures 204 and 205 with lateral or horizontal maneuverability.

Figure 5:
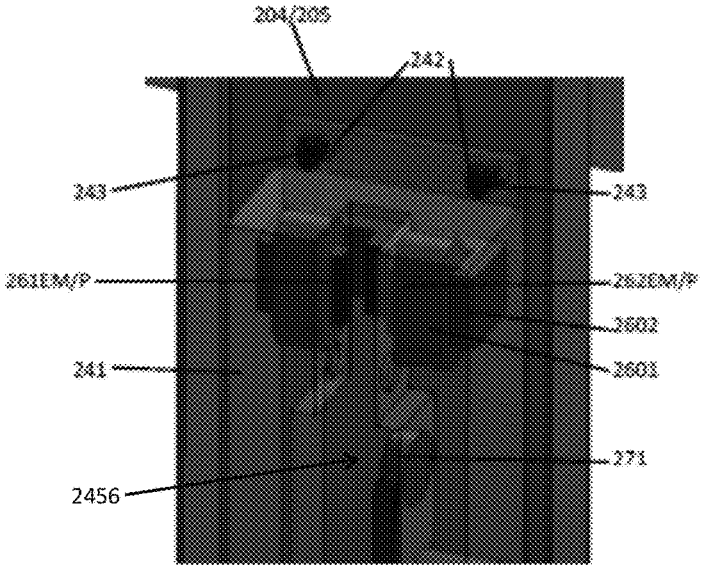
FIG. 5 is a perspective view of a portion of the ESA of FIG. 3.

As shown in FIG. 5 and, in accordance with embodiments, the lateral or horizontal maneuverability is provided by the ESA body 241 being formed to define lateral or horizontal grooves 242. Fasteners 243 extend through these lateral or horizontal grooves 242 and are tightened onto the corresponding one of the first and second car frame structures 204 and 205 such that the ESA body 241 can move laterally or horizontally in one direction until the fasteners 243 abut first ends of the lateral or horizontal grooves 242 and in an opposite direction until fasteners 243 abut second ends of the lateral or horizontal grooves 242.

Figure 6:
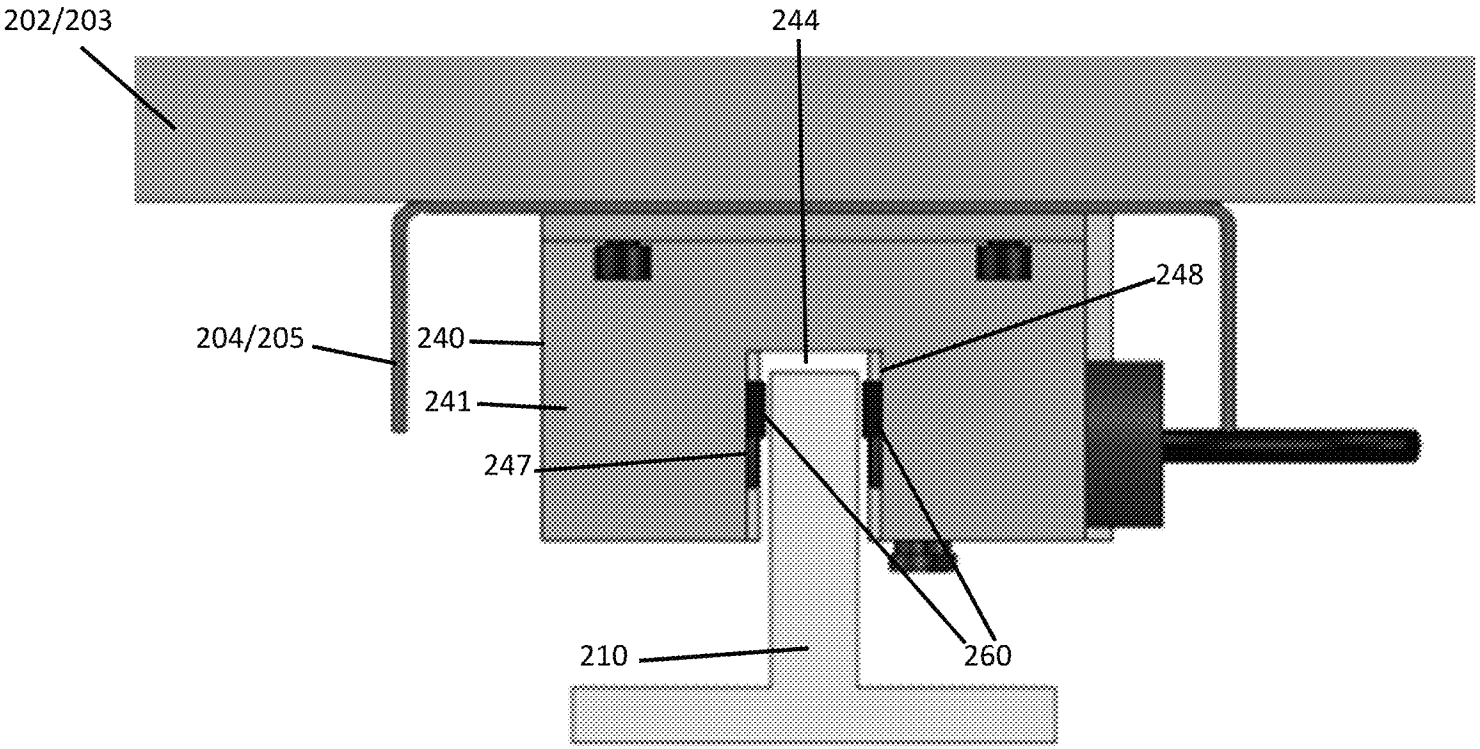
FIG. 6 is an axial view of the ESA of FIG. 3.

As shown in FIGS. 4-6 and, in accordance with embodiments, the ESA body 241 is further formed to define a guide rail groove 244, which generally aligns with the channel 232 of the corresponding safety 230. The guide rail groove 244 extends along a substantial length of the ESA body 241 and is receptive of the guide corresponding guide rail 210 (see FIG. 3). The guide rail groove 244 has an upper portion 245, a lower portion 246, a middle portion 2456 between the upper portion 245 and the lower portion 246, a first side 247 and a second side 248. A horizontal distance between the first side 247 and the second side 248 is greater than a thickness of the corresponding guide rail 210 such that the corresponding guide rail 210 can translate through the guide rail groove 244 without coming into contact with either the first side 247 or the second side 248.

Figure 7:
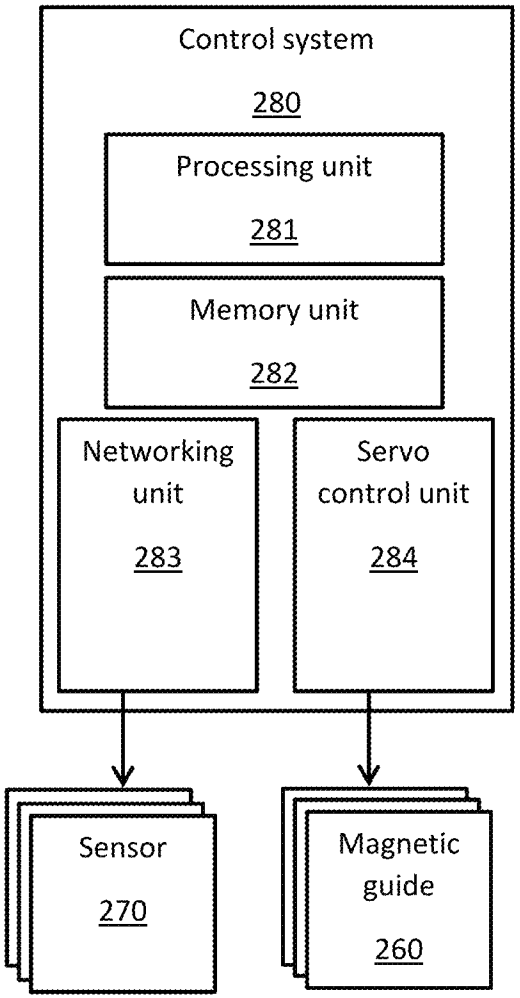
FIG. 7 is a schematic diagram of a control system in accordance with embodiments.

With continued reference to FIGS. 3-6 and with additional reference to FIG. 7, each ESA 240 further includes magnetic guides 260, sensors 270 and a control system 280 (see FIG. 7). The magnetic guides 260 are operably disposed within the guide rail groove 244 to exert magnetic forces on the corresponding guide rail 210. The sensors 270 are operably disposed within the guide rail groove 244 to sense lateral or horizontal distances between the corresponding guide rail 210 and the first sand second sides 247 and 248 of the ESA body 241. The control system 280 is configured to control the magnetic guides 260 to exert the magnetic forces in accordance with readings of the sensors 270 to maneuver the ESA body 241 in lateral or horizontal directions to thereby maintain the lateral or horizontal distances between the corresponding guide rail 210 and the first sand second sides 247 and 248 of the ESA body 241.

The magnetic guides 260 may include one or more electro-magnets (261-264EM in FIG. 4) respectively disposed in at least one of the upper portion 245 of the guide rail groove 244, the lower portion 246 of the guide rail groove 244 and the middle portion 2456 of the guide rail groove 244. In some embodiments, the magnetic guides 260 may further include one or more permanent magnets (261-

264P in FIG. 4) respectively disposed to magnetically oppose the one or more electro-magnets (261-264EM in FIG. 4).

The magnetic guides 260 may be provided as first and second sets of magnetic guides. Alternatively, a single set of magnetic guides 260, or two or more sets of magnetic guides may be employed.

In an exemplary case, a first set of magnetic guides may be operably disposed within the upper portion 245 of the guide rail groove 244 and include an upper, first electro-magnetic guide 261EM that is disposed on the first side 247 and an upper, second electro-magnetic guide 262EM that is disposed on the second side 248. A second set of magnetic guides may be operably disposed within the lower portion 246 of the guide rail groove 244 and include a lower, first electro-magnetic guide 263EM that is disposed on the first side 247 and a lower, second electro-magnetic guide 264EM that is disposed on the second side 248. Each magnetic guide 260 may include a ferromagnetic core 2601 and windings 2602 that are energizable to generate the magnetic force.

The sensors 270 may be provided as an upper sensor 271 that is operably disposed within the upper portion 245 of the guide rail groove 244 and a lower sensors 272 that is operably disposed within the lower portion 246 of the guide rail groove 244.

In accordance with further embodiments, additional sensors 270 could be provided as well. For example, two upper sensors 271 and two lower sensors 272 could be provided on either side of the guide rail groove 244 for additional sensing capability or redundancy.

The upper, first electro-magnetic guide 261EM can exert a repulsive magnetic force toward the corresponding guide rail 210, which can be directed and magnified so as to maintain a distance between the corresponding guide rail 210 and the first side 247 in the upper portion 245. The upper, second electro-magnetic guide 262EM can exert a repulsive magnetic force toward the corresponding guide rail 210, which can be directed and magnified so as to maintain a distance between the corresponding guide rail 210 and the second side 248 in the upper portion 245. Thus, the upper, first electro-magnetic guide 261EM and the upper, second electro-magnetic guide 262EM cooperatively operate to maintain the corresponding guide rail 210 substantially close to a center portion between the first and second sides 247 and 248 in the upper portion 245.

The lower, first electro-magnetic guide 263EM can exert a repulsive magnetic force toward the corresponding guide rail 210, which can be directed and magnified so as to maintain a distance between the corresponding guide rail 210 and the first side 247 in the lower portion 246. The lower, second electro-magnetic guide 264EM can exert a repulsive magnetic force toward the corresponding guide rail 210, which can be directed and magnified so as to maintain a distance between the corresponding guide rail 210 and the second side 248 in the lower portion 246. Thus, the lower, first electro-magnetic guide 263 and the lower, second electro-magnetic guide 264EM cooperatively operate to maintain the corresponding guide rail 210 substantially close to a center portion between the first and second sides 247 and 248 in the lower portion 246.

In accordance with further embodiments, fewer or additional magnetic guides 260 could be provided. For example, one or more electro-magnetic guides could be operably disposed in the middle portion 2456 of the guide rail groove 244 in a similar manner as described above. As another example, the upper, first electro-magnetic guide 261EM could be paired with only the lower, second electro-magnetic guide 264EM. In such cases, the upper, first electro-magnetic guide 261EM and the lower, second electro-magnetic guide 264EM act in concert with one another to generate repulsive and/or attractive magnetic forces that maintain the corresponding guide rail 210 substantially close to a center portion between the first and second sides 247 and 248 in the upper and lower portions 245 and 246.

To the extent that one or more of the magnetic guides 260 is a permanent magnet, the permanent magnet can be operably disposed to oppose the magnetic force applied to the corresponding guide rail 210 by one or more proximal electro-magnetic guides. For example, the upper, first electro-magnetic guide 261EM could be opposed by the upper, second permanent magnetic guide 262P and the lower, first electro-magnetic guide 263EM could be opposed by the lower, second permanent magnetic guide 264P. In such cases, the upper, first electro-magnetic guide 261EM and the lower, first electro-magnetic guide 263EM act in concert against the opposing forces of the upper, second permanent magnetic guide 262P and the lower, second permanent magnetic guide 264P to generate repulsive magnetic forces that maintain the corresponding guide rail 210 substantially close to a center portion between the first and second sides 247 and 248 in the upper and lower portions 245 and 246.

As shown in FIG. 7, the control system 280 includes a processing unit 281, a memory unit 282, a networking unit 283, by which the processing unit 281 communicates with the sensors 270, and a servo control unit 284, by which the processing unit 281 instructs and controls operations of the magnetic guides 260. The memory unit 282 has executable instructions stored thereon, which are readable and executable by the processing unit 281. When the executable instructions are read and executed by the processing unit 281, the executable instructions cause the processing unit 281 to receive readings from the sensors 270 and to control the magnetic guides 260 to exert the magnetic forces toward the corresponding guide rail 210 in accordance with readings of the sensors 270 to maneuver the ESA body 241 in lateral or horizontal directions to thereby maintain the lateral or horizontal distances between the corresponding guide rail 210 and the first sand second sides 247 and 248 of the ESA body 241.

For example, in an event that the processing unit 281 determines from the readings of the upper sensor 271 that the corresponding guide rail 210 has drifted toward the first side 247 such that the distance between the corresponding guide rail 210 and the first side 247 is less than a predefined distance threshold, processing unit 281 will effectively cause the upper, first magnetic guide 261 to increase the repulsive magnetic force exerted onto the corresponding guide rail 210 as compared to the repulsive force exerted onto the corresponding guide rail 210 by the upper, second magnetic guide 262. This will have the effect of driving the ESA body 241 in the lateral or horizontal directions along the lateral or horizontal grooves 242 toward re-centering the corresponding guide rail 210 in the upper portion 245 of the guide rail groove 244. Similarly, in an event that the processing unit 281 determines from the readings of the upper sensor 271 that the corresponding guide rail 210 has drifted toward the second side 248 such that the distance between the corresponding guide rail 210 and the second side 248 is less than a predefined distance threshold, processing unit 281 will effectively cause the upper, second magnetic guide 262 to increase the repulsive magnetic force exerted onto the corresponding guide rail 210 as compared to the repulsive force exerted onto the corresponding guide rail 210 by the upper, first magnetic guide 261. Again, this will have the effect of driving the ESA body 241 in the lateral or horizontal directions along the lateral or horizontal grooves 242 toward re-centering the corresponding guide rail 210 in the upper portion 245 of the guide rail groove 244.

Figure 8:
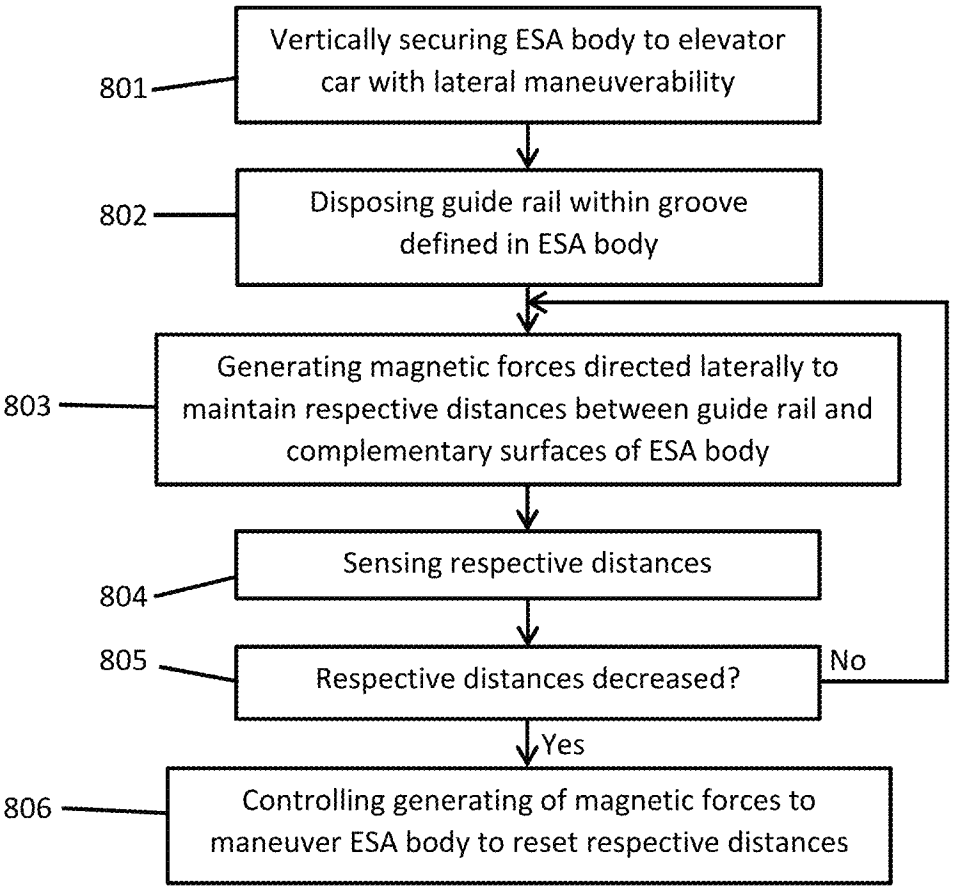
FIG. 8 is a flow diagram illustrating a method of operating an elevator system in accordance with embodiments.

With reference to FIG. 8, a method of operating an ESA of an elevator car is provided. As shown in FIG. 8, the method includes vertically securing an ESA body to the elevator car with lateral or horizontal maneuverability (801) and disposing a guide rail for translation within a groove defined in an ESA body (802). The method further includes generating magnetic forces that are directed laterally or horizontally to maintain respective horizontal distances between the guide rail and complementary surfaces of the ESA body (803), sensing the respective distances (804), determining whether the respective distances have decreased (805) and, in an event the respective distances have decreased, controlling the generating of the magnetic forces to maneuver the ESA body laterally to reset the respective horizontal distances (806).

Technical effects and benefits of the present disclosure are the elimination of the wear and tear and the noise or vibration of gibs or rollers that are normally used to maintain ESA clearance from guide rails. In addition, the ESA guidance system can be independent of elevator speed and may allow for increased high speed displacement (e.g., in excess of 20 m/s).

While the disclosure is provided in detail in connection with only a limited number of embodiments, it should be readily understood that the disclosure is not limited to such disclosed embodiments. Rather, the disclosure can be modified to incorporate any number of variations, alterations, substitutions or equivalent arrangements not heretofore described, but which are commensurate with the spirit and scope of the disclosure. Additionally, while various embodiments of the disclosure have been described, it is to be understood that the exemplary embodiment(s) may include only some of the described exemplary aspects. Accordingly, the disclosure is not to be seen as limited by the foregoing description, but is only limited by the scope of the appended claims.

What is claimed is:

1. An elevator car comprising:

a car frame which translates along a guide rail during ascents or descents;

a safety disposed along the car frame to selectively engage with the guide rail to selectively permit vertical elevator car movement;

an electronic safety actuator (ESA) configured to actuate the safety and comprising:

an ESA body secured to the car frame with horizontal maneuverability and defining a groove through which the guide rail translates during the vertical elevator car movement;

a magnetic guide operably disposed within the groove to exert magnetic force on the guide rail; and a sensor disposed within the groove to sense horizontal distance between the guide rail and corresponding portions of the ESA body; and a control system configured to control the magnetic guide to exert a magnetic force in accordance with reading of the sensor to maneuver the ESA body horizontally, wherein the magnetic guide comprises:

an electro-magnet disposed in an upper portion of the groove at one of a first and second side of the guide rail;

a permanent magnet disposed in the upper portion of the groove at the other one of the first and the second side of the guide rail to magnetically oppose the electro-magnet in the upper portion of the groove;

an electro-magnet disposed in a lower portion of the groove at one of a first and second side of the guide rail; and a permanent magnet disposed in the lower portion of the groove at the other one of the first and the second side of the guide rail to magnetically oppose the electro-magnet in the lower portion of the groove.

2. The elevator car according to claim 1, wherein the car frame, the safety and the ESA are provided in sets on opposite elevator car sides.

3. The elevator car according to claim 1, wherein the ESA comprises a linkage coupled to the ESA body and the safety for actuation of the safety.

4. The elevator car according to claim 1, wherein the ESA body defines horizontal grooves through which a fastener extends into the car frame.

5. The elevator car according to claim 1, wherein the magnetic guide is provided as:

a first pair of magnetic guides disposed on opposite sides of an upper portion of the groove; and a second pair of magnetic guides disposed on opposite sides of a lower portion of the groove.

6. The elevator car according to claim 1, wherein the control system is configured to control the magnetic guide to increase the magnetic force when the readings of the sensor are indicative of the horizontal distance decreasing.

* * * * *